US005687965A

United States Patent [19]

Matsuda et al.

[11] Patent Number: 5,687,965

[45] Date of Patent: Nov. 18, 1997

[54] SHEET SUPPLYING DEVICE

[75] Inventors: Naoyuki Matsuda; Hajime Takei; Homare Sano, all of Machida, Japan; Richard R. Lemberger, Columbus Township, Anoka County; Stuart J. Wyman, Minneapolis, both of Minn.

[73] Assignee: Minolta Camera Kabushiki Kaisha, Osaka, Japan

[21] Appl. No.: 674,975

[22] Filed: Jul. 3, 1996

Related U.S. Application Data

[63] Continuation of Ser. No. 533,385, Sep. 25, 1995, abandoned, which is a continuation of Ser. No. 218,983, Mar. 28, 1994, abandoned, which is a continuation of Ser. No. 144,482, Oct. 21, 1993, abandoned, which is a continuation of Ser. No. 734,308, Jul. 19, 1991, abandoned.

[30] Foreign Application Priority Data

Jul. 20, 1990 [JP] Japan ..... 2-193292
Jul. 20, 1990 [JP] Japan ..... 2-193293

[51] Int. Cl.[6] ..... B65H 9/12

[52] U.S. Cl. ..... 271/241; 271/145; 271/162; 271/236; 271/245

[58] Field of Search ..... 271/11, 241, 164, 271/162, 104, 106, 107, 236, 238, 240, 245, 246, 272, 273, 145

[56] References Cited

U.S. PATENT DOCUMENTS 4,372,547 2/1983 Yanagawa et al. ..... 271/164 X
4,516,763 5/1985 Stahl et al. ..... 271/11
4,621,272 11/1986 Toriumi et al. ..... 346/134
4,621,800 11/1986 Bauer et al. ..... 271/11
4,768,772 9/1988 Ochiai et al. ..... 271/164
4,867,436 9/1989 Hanada et al. ..... 271/221
4,905,053 2/1990 Matsuo et al. ..... 355/319

FOREIGN PATENT DOCUMENTS 324594 7/1989 European Pat. Off. ..... 271/11
63-112351 5/1988 Japan ..... 271/241

*Primary Examiner*—David H. Bollinger
*Attorney, Agent, or Firm*—Sidley & Austin

[57] ABSTRACT

A sheet supply device supplying sheets from a magazine thereof to an image forming apparatus and a mechanism for setting the magazine to a body of the image forming apparatus. The magazine storing stacked sheets is provided with reinforcing members which are disposed at side walls of the magazine to form convex portions relative thereto so as to reinforce the side walls and regulate the position of the stacked sheets in a sheet width direction. A projecting portion having an inclined surface is provided in either the magazine or a receiving portion in the image forming apparatus body to which the magazine is set. When the magazine is slid on an upper surface of the receiving portion for being set to the image forming apparatus body, a leading end of the magazine in a magazine setting direction is lifted by use of the inclined surface of the projecting portion so as to be accurately and smoothly set to the body.

10 Claims, 14 Drawing Sheets

SHEET SUPPLYING DEVICE

This application is a continuation of application Ser. No. 08/533,385 filed Sep. 25, 1995, now abandoned, which is a continuation of application Ser. No. 08/218983 filed Mar. 28, 1994, now abandoned, which is a continuation of application Ser. No. 08/144,482 filed Oct. 21, 1993, now abandoned, which is a continuation of application Ser. No. 07/734,308 filed Jul. 19, 1991, now abandoned.

BACKGROUND OF THE INVENTION

1. Field of the Invention

The present invention relates to a sheet supplying device for use in an image forming apparatus, and more specifically relates to a sheet supplying device capable of supplying within the image forming apparatus a plurality of photosensitive film sheets, coated paper or the like, one sheet at a time.

2. Description of the Related Art

A variety of sheet supplying devices are known in the field of copying machines and printers wherein the uppermost sheet in a stack of sheets accommodated in a magazine is picked up and supplied therefrom one sheet at a time. In consideration of possible positional dislocation of the sheets stacked in the magazine and skewing of the sheet sent out from the magazine during the feeding process, the orientation of the sheet must be corrected in a direction perpendicular to a paper feeding direction (hereinafter referred to as the "widthwise direction") after feeding and immediately prior to reaching the processing portion (for example, at the image exposure position). When the distance between the magazine and the image exposure position is shortened to allow more compactness in the design of the device, the widthwise orientation of the sheet can be corrected with the leading half of the sheet fed from the magazine while the remaining half of the sheet still remains within the magazine. Even if the aforesaid skewing correction is performed, the trailing end of the sheet will make contact with the lateral wall of the magazine, thereby inhibiting adequate positional correction of the sheet so as to preclude proper feeding.

The aforesaid conventional type of magazine is removably installed in a magazine accommodating portion of the main body, and adjacent to the leading end of the magazine, as viewed from the direction of installation, is provided a mechanism for winding a shade cover for the magazine so that access to that region by the operator is impossible. Further, the magazine is quite heavy when filled to capacity, and manually loading the magazine directly into the installation loading platform so as to achieve proper positioning is a problem.

Therefore, consideration should be given to a method for sliding the magazine into position on the loading platform while the magazine is in an inclined state when the leading end thereof makes contact with the top of the loading platform. However, in order to attach the shade cover to the magazine, a cushion member must be provided at the top face of the loading platform opposite the flange of the magazine. While the flange of the magazine is in a state of contact with the aforesaid cushion member, it is extremely difficult to adjust the position of the magazine when the magazine is installed in the main unit.

SUMMARY OF THE INVENTION

A main object of the present invention is to provide a sheet supplying device capable of feeding sheets in a suitable state.

Another object of the present invention is to provide a sheet supplying device capable of correcting the orientation of the sheet even during feeding of the sheet in the magazine.

A further object of the present invention is to provide a sheet supplying device having a magazine capable of being readily and precisely installed on the loading platform of the main body.

These and other objects of the invention are achieved by providing a sheet supplying device having:

storing means including a bottom plate having stacked sheets thereon and side walls for storing the stacked sheets;

supply means for supplying the sheets from the storing means into an image forming apparatus one by one;

regulating means for regulating the position of the sheet in a sheet width direction when the sheet is supplied to the image forming apparatus by the supply means; and reinforcing means provided at said side walls to form convex portions relative thereto so as to reinforce the side walls and regulate the position of the sheet in the sheet width direction.

These objects of the present invention are further achieved by providing a sheet supplying device having:

a receiving portion provided at a body of an image forming apparatus and having a protruding member on an upper surface thereof; and storing means for storing stacked sheets therein, said storing means attachable to the body of the image forming apparatus at an attached position in the receiving portion by being slid on the upper surface of the receiving portion and provided at a bottom surface thereof with a projecting portion having an inclined surface, so that a leading end of the storing means with respect to a storing means attaching direction lifts immediately in front of the attached position when the storing means is slid on the upper surface of the receiving portion.

These and other objects, advantages and features of the invention will become apparent from the following description thereof taken in conjunction with the accompanying drawings which illustrate a specific embodiment of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

Figure 1:
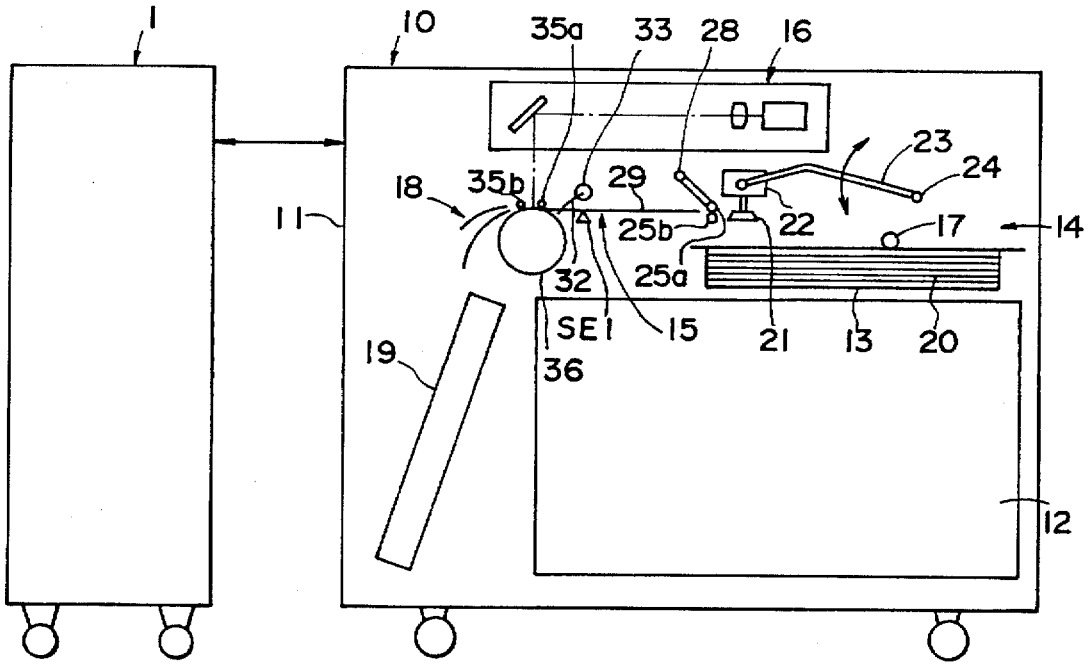
FIG. 1 shows the overall construction of a printer including a magazine using the sheet supplying device of the present invention.

FIG. 1 shows the overall construction of a printer including the magazine and magazine loading platform of the present invention. The printer 10 provides a main body 11 having an internal portion formed in a black box state having arranged therein a battery box 12, film magazine 13, film feeding device 14, film transporting portion 15, optical unit 16, sub-scanning unit 18, and receiving magazine 19, as shown in the drawing.

The magazine 13 is replaceably loaded above the battery box 12, and accommodates a stack of unexposed photosensitive film 20. The magazine 13 is formed with an opening that is automatically covered as required with a sheet-like shielding cover 41 (refer to FIG. 2).

As shown in FIG. 1, at the top of the aforesaid magazine 13 is provided a vacuum type film feeding device 14 for feeding the stacked sheets of photosensitive film 20 accommodated in the magazine one sheet at a time.

The film feeding device 14 comprises a vacuum disk 21, holding unit 22 for the vacuum disk, and an arm 23 pivotable on a shaft 24 and having one end thereof mounted to the shaft 24 and the other end thereof attached to the holding unit 22. The vacuum disk 21 picks up via vacuum suctioning the uppermost film sheet 20 of the stack accommodated in the magazine 13 and rotates it in the arrow direction indicated in the drawing while keeping the position thereof horizontal. The film sheet 20 adhered to the vacuum disk 21 is fed between the pair of transport rollers 25*a* and 25*b* retractably provided at the entrance of the film transport portion 15.

The upper roller 25*a* of the pair of transport rollers 25*a* and 25*b* at the film transport portion 15 rotates about a shaft 28 so as to be retractable from contact with the bottom roller 25*b*. When the top roller 25*a* and the bottom roller 25*b* are in the released state, the leading end of the single film sheet 20 picked up by the vacuum disk 21 is fed between said rollers 25*a* and 25*b*. Then, with the top roller 25*a* and the bottom roller 25*b* in a state of pressing contact, the film sheet 20 gripped between the rollers is fed onto the transport guide plate 29. A stopper 32 is provided so as to be pivotable on a shaft 33. When a solenoid 34 (shown in FIG. 3) connected to the end of the shaft 33 is in the off state, the stopper 32 is retracted from the transport portion 15. When the solenoid 34 is turned on, the stopper 32 enters into the transport portion 15 so that the film sheet 20 transported onto the transport guide plate 29 makes contact with the stopper 32 and is temporarily arrested to regulate the position of the sheet. Inadequate transport of the film sheet 20 is detected by a combination of the film detection sensor SE1 and a timer.

The sub-scanning unit 18 comprises a pair of rotatable nip rollers 35*a* and 35*b* which are coated in an elastic material, and a sub-scan drum 36 which is rotatably driven in the counterclockwise direction in FIG. 1. When the film sheet 20 is released by the stopper 32, it moves onto the sub-scan drum 36. At this time, the film sheet 20 is exposed by the laser beam emitted from the optical unit 16 for the main scan in the axial direction of the sub-scan drum 36, then is discharged into the magazine 19. The receiving magazine 19 accommodating the exposed film sheet 20 is taken from the printer 10 in a shielded condition, for post developing processing. Alternatively, the magazine 19 may previously store a developing device for successively developing the exposed film sheet 20, then discharged out of the printer 10.

On the other hand, a host device 1 is provided adjacent to the printer 10. The image information to be printed is transmitted from the host device 1 to the printer 10 one image segment at a time.

Figure 2:
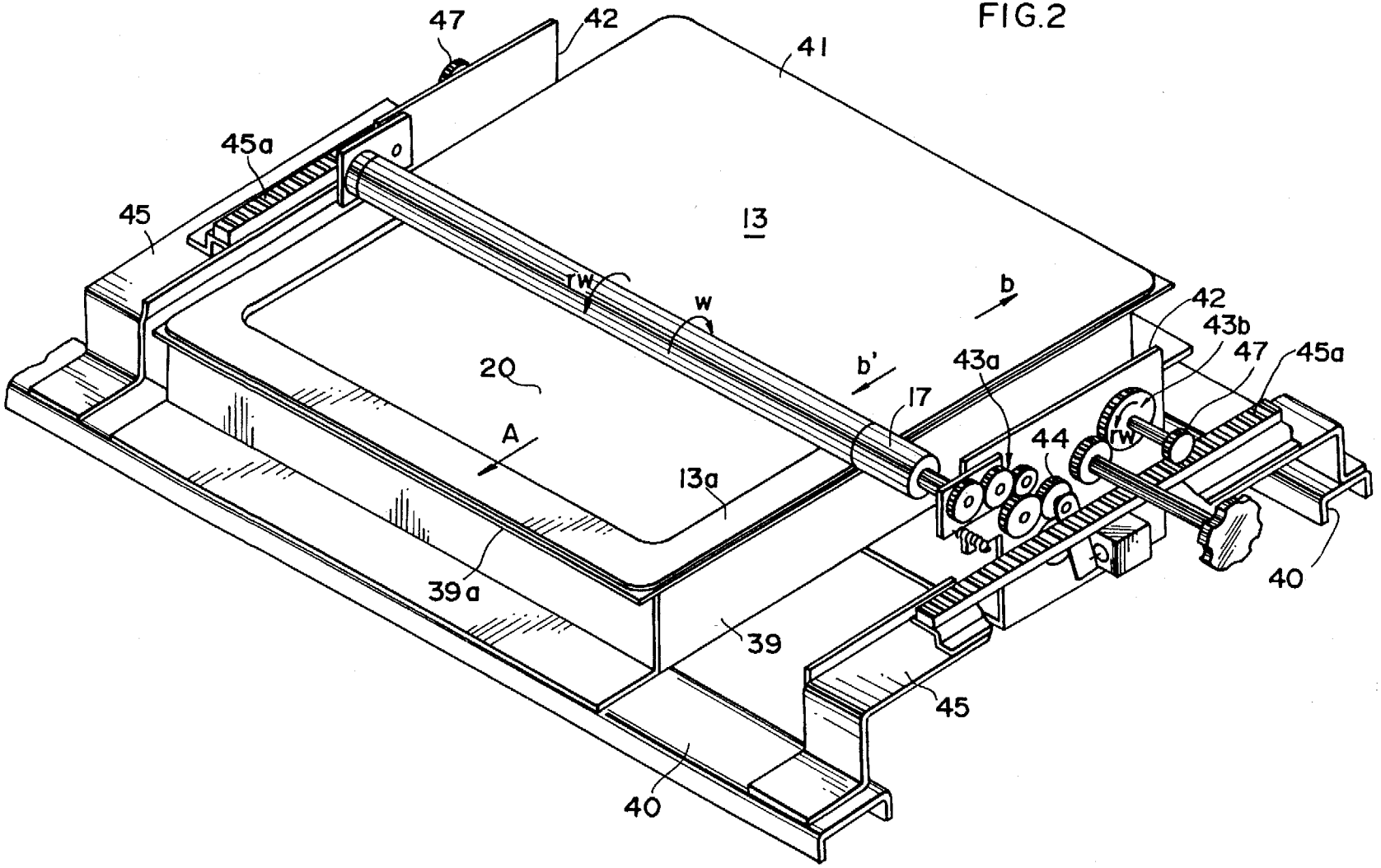
FIG. 2 is a perspective view showing the magazine in the installed state and the cover in the rolled state.

The mechanism of the magazine 13, and specifically the cover winding device is described hereinafter with reference to FIG. 2.

The magazine 13 which accommodates the stacked photosensitive film sheets 20 is a container made of light-shielding plastic material having a flange 13*a* provided on the top surface thereof. Adhesive tape is adhered to the aforesaid flange 13*a*, so that the sheet-like shade cover 41 can be repeatedly adhered to and peeled from the top surface of the magazine 13 by means of the aforesaid adhesive tape provided on the flange 13*a*.

The magazine 13 is loaded into the main body 11 of the apparatus with the flange 13*a* disposed on the top of the frame-like magazine loading platform 39. In order to reliably adhere to sheet-like cover 41 of the magazine 13 on the flange 13*a*, a cushion member is provided on the upper surface of the loading portion 39*a* of magazine loading platform 39 to which the flange 13*a* is loaded. The magazine loading platform 39 is integrally and fixedly attached to two base members 40 provided in the front and rear portions. The base members 40 are downwardly extractable from within the main body 11 at a rightward incline, as shown in the FIG. 2, by opening the magazine compartment door (not shown in the drawing). Accordingly, loading of the magazine 13 into the main body 11 is accomplished by pulling out the base members 40.

The cover winding portion is provided for winding the cover 41 of the magazine 13 by peeling the cover 41 from the magazine 13 while re-winding the cover 41. The cover winding portion comprises a winding shaft 17 rotatably provided on support frame 42 at both sides and below the magazine loading platform 39 and magazine 13, winding motor (not shown in the drawing), and gear mechanisms 43*a* and 43*b*. Pinions 47 provided on the support frame 42 are connected to a pair of racks 45*a* provided on rack supporting plates 45 extending across the base members 40, so as to move the winding shaft 17 horizontally on the flange 13*a* of magazine 13.

When the cover 41 is being wound, the gear 44 rotatably driven by the winding motor engages with the gear mechanism 43*a*, so as to rotate the winding shaft 17 in the direction of the arrow w. When the end portion of the cover 41 is arrested by the winding shaft 17, it is gradually wound thereupon via the rotation of the winding shaft 17, and the supporting frame 42 moves on the racks 45*a* in the direction of the arrow b. Consequently, the cover 41 is peeled from the top of the flange 13*a*, and the film accommodated inside the magazine is fed therefrom through the resulting opening.

On the other hand, every time the cover 41 is rewound, the gear 44 engages the gear mechanism 43*b*, and the winding motor is reversely rotated, thereby rotatably driving the pinion 47 in the direction of the arrow rw, and moving the supporting frame 42 in the direction of the arrow b'. Since the winding shaft 17 is in a free rotation state at this time, said shaft 17 is rotated on top of the flange 13*a* in the direction of the arrow rw, and the cover 41 wound around the shaft 17 is gradually adhered to the top of the flange 13*a*. At this time, because the cushion member 61 is provided on the top surface of the loading portion 39*a*, the flange 13*a* and the cover 41 of magazine 13 are suitably sealed between the loading portion 39*a* and the winding shaft 17 so as to provide a reliable shield.

The construction and operation of the film feeding device 14, and specifically the lateral regulating panels 50 and 55 for regulating the film sheet 20 perpendicular to the feed direction are hereinafter described with reference to the accompanying drawings.

Figure 3:
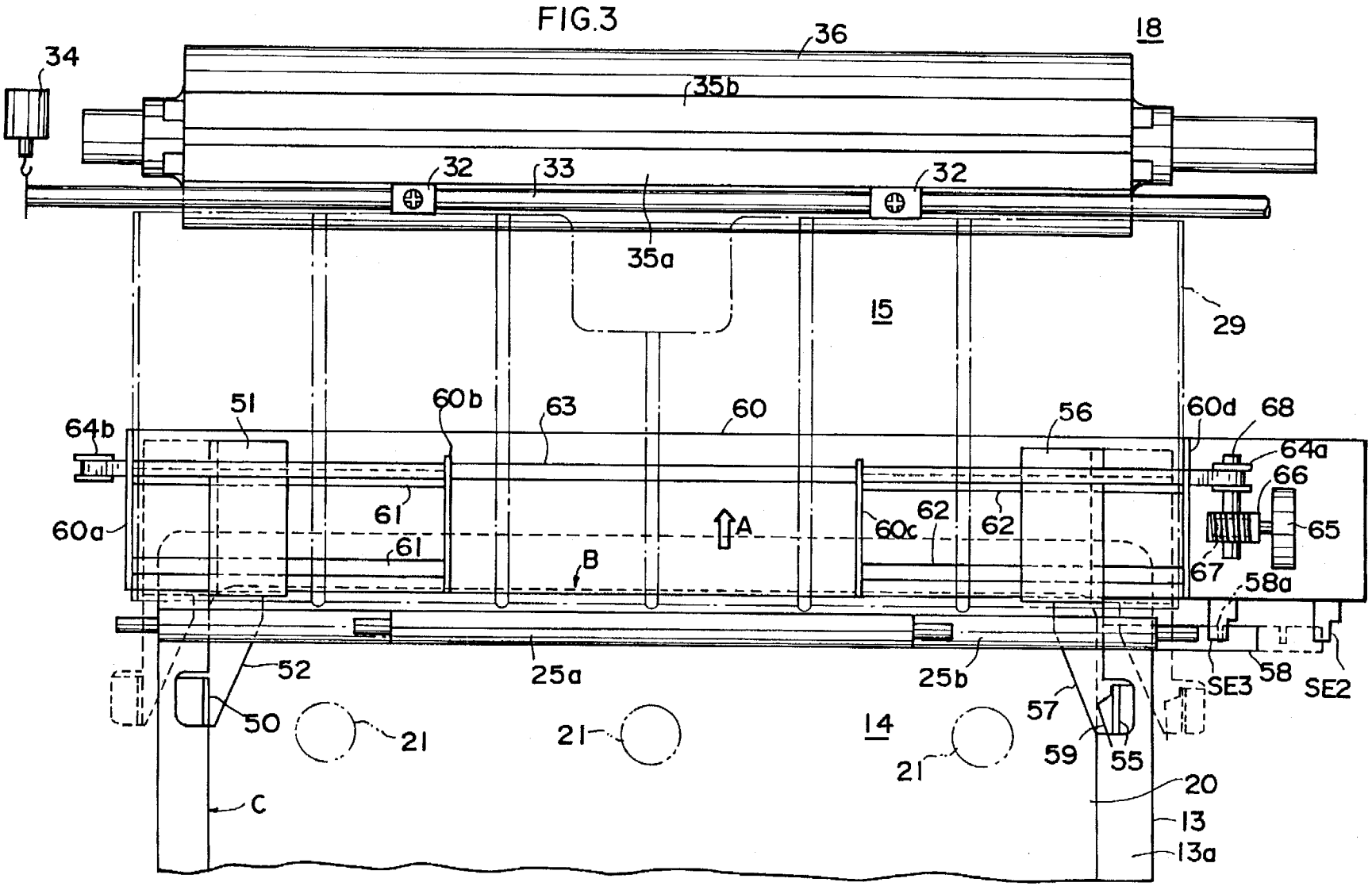
FIG. 3 is a top plan view of the sheet supplying device.

The magazine 13 is set so as to have the leading end of the film sheets 20 stacked therein positioned at point B in FIG. 3. The vacuum disk 21 is provided at three locations in the widthwise direction of the sheet 20, and is capable of suctioning the leading end portion of the uppermost film sheet 20 accommodated in the magazine. On both sides and adjacent to the vacuum disk 21 are provided a pair of right and left lateral regulating panels 50 and 55. The lateral regulating panels 50 and 55 are mounted perpendicularly so as to sandwich therebetween the film sheet 20 at the leading edge of the handling members 52 and 57 fixedly attached in the horizontal direction to the guide blocks 51 and 56. The lateral guide panels 55 are provided on the inner side thereof plastic films 59 having elastic properties.

Figure 4:
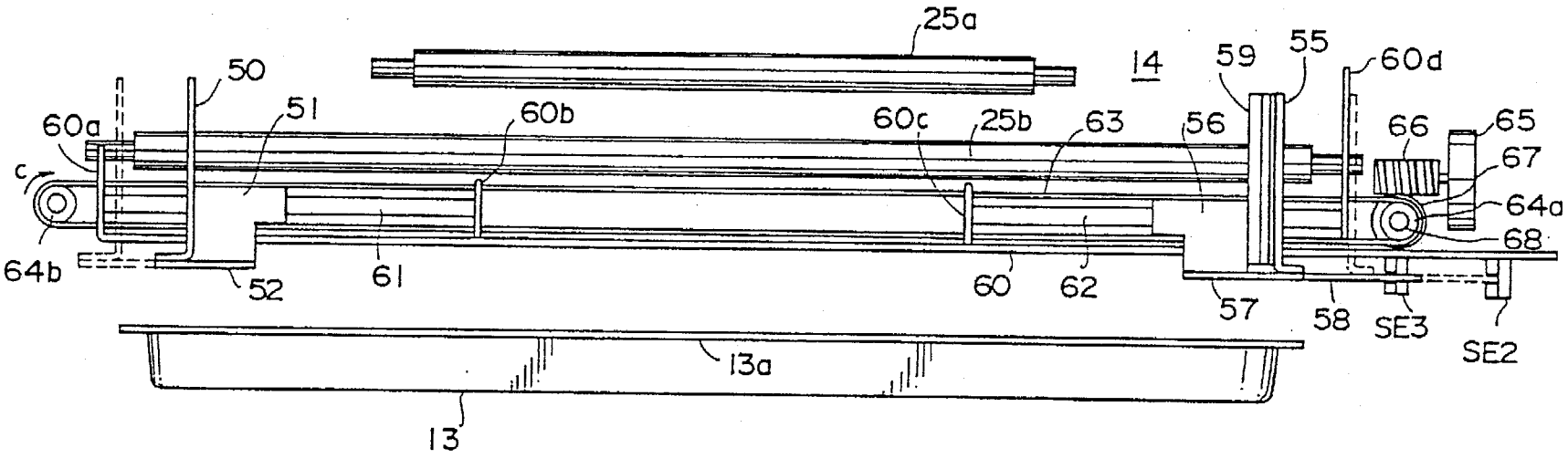
FIG. 4 is a front elevation view of the magazine.
Figure 5:
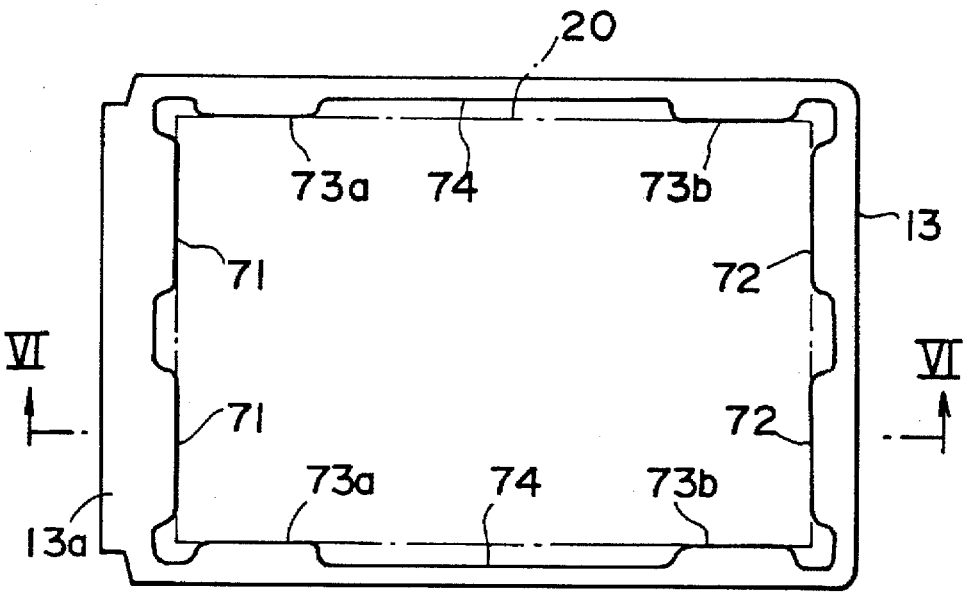
FIG. 5 is a top plan view of the magazine.
Figure 6:
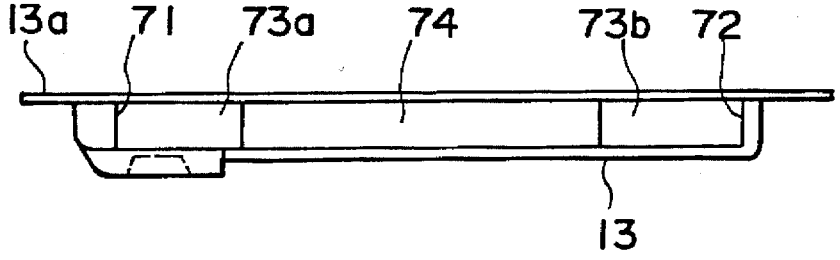
FIG. 6 is a sectional view of the magazine along the VI—VI line shown in FIG. 5.

A frame 60 is provided below the transport guide plate 29 perpendicular to the transport direction A. The guide blocks 51 and 56 are slidably installed in the film sheet 20 width direction on the guide rods 61 and 62 arranged at the protrusions 60*a*, 60*b*, 60*c* and 60*d* on frame 60. Further, a timing belt 63 is reeved around the pulleys 64*a* and 64*b* along the entire length of the frame 60 and parallel to the guide rods 61 and 62. The guide block 51 is fixedly attached on the top side of the belt 63, and the guide block 56 is fixedly attached at the bottom side of the belt 63. A pulse motor 65 is provided at one end of the frame 60, and a worm wheel 67 meshes with the worm 66 fixedly attached to the output shaft of the motor 65 and is fixedly attached to the support shaft 68 with pulley 64*a*. Accordingly, when the pulse motor 65 is forward rotated, the timing belt 63 is rotated in the direction of arrow c in FIG. 4, the guide blocks 51 and 56 move along the interior side thereof with handling members 52 and 57 and lateral regulating panels 50 and 55. On the other hand, when the pulse motor 65 is reversely rotated, the timing belt is rotated in the opposite direction to that indicated by arrow c, and the guide blocks 51 and 56 move along the exterior side thereof with handling members 52 and 57 and lateral regulating panels 50 and 55.

The amount of movement of the lateral regulating panels 50 and 55 is controlled by the number of drive pulses applied to the pulse motor 65. Thus, the handling member 57 is provided a protruding member 58 having a slit 58*a* formed therein, and photosensors SE2 and SE3 are mounted to the frame 60 to detect the protruding member 58 and the slit 58*a*. The photosensor SE2 detects the leading end of the protruding member 58 when the pulse motor 65 is reversely rotated. The reverse rotation of the pulse motor 65 is switched off by the aforesaid detection signal of the sensor SE2, and the lateral regulating panels 50 and 55 are set in the home position (indicated by the broken lines in FIGS. 3 and 4). The photosensor SE3 detects the slit 58*a* formed in the protruding member 58, and the lateral regulating panels 50 and 55 are set in the regulating position (indicated by the solid lines in FIGS. 3 and 4) by the aforesaid detection signal.

During the time the film sheet 20 is regulated in the width direction, the lateral regulating panel 50 is set in regulating position C (FIG. 3) corresponding to one side of the film sheet 20. On the other hand, the other lateral regulating panel 55 is set about 3 mm to the outside from the other side of the film sheet 20, and the plastic film 59 adhering to the inner side thereof is elastically pressed against the film sheet 20 so as to induce a positional adjustment of the film sheet 20 in the widthwise direction with the lateral regulating panel 50 being the reference. The plastic film 59 on the lateral regulating panel 55 is provided to absorb a fixed tolerance in the widthwise dimension of the film sheet 20, and to precisely adjust the feed position of the film sheet 20.

A description of the film feeding operation follows below. First, the vacuum disk 21 is lowered and suctions the top surface of the film sheet 20 accommodated in the magazine 13. Thereafter, the vacuum disk 21 is raised while holding the leading end of the suctioned film sheet 20. While thus being raised, the right and left end portions of the film sheet 20 come into contact with the handling members 52 and 57 from below. Then, the right and left end portions of the suctioned film sheet 20 ride across the handling members 52 and 57 in a somewhat downwardly curved state. Consequently, even if a plurality of film sheets 20 adhering to the back surface of the uppermost sheet 20 are simultaneously raised with the same uppermost film sheet 20, the second and subsequent sheets 20 are separated from the uppermost film sheet 20 when passing over the handling members 52 and 57, and thereby fall back into the magazine 13.

Thus, the leading end of the single fed film sheet 20 is positioned on the bottom roller 25*b* while the top roller 25*a* is in a retracted state, as shown in FIG. 1, whereupon the vacuum suctioning applied by the vacuum disk 21 is released. Thereafter, the top roller 25*a* is lowered so that the leading end of the film sheet 20 is held between said top roller 25*a* and the bottom roller 25*b*, and is then transported on top of the guide plate 29 toward the sub-scanning unit 18.

Subsequently, when the film sheet 20 reaches the detection point of the film sensor SE1 within a specified time, the film sensor SE1 is switched on and the top roller 25*a* is again raised. The bottom roller 25*b* continues to be rotatably driven even after the top roller 25*a* is raised, so that the film sheet 20 receives the transporting force of only the bottom roller 25*b* with virtually no bunching. Skewing of the film sheet 20 is corrected by the leading end of the transported sheet 20 making contact with the stopper 32. Simultaneously with the on-going transport of the film sheet 20 on the guide plate 29, the lateral guide panels 50 and 55, which are somewhat outwardly retracted from both sides of the film sheet 20, are moved to the regulating position (positions indicated by the solid lines in FIGS. 3 and 4) to adjust the feeding position of the film sheet 20.

Figure 7:
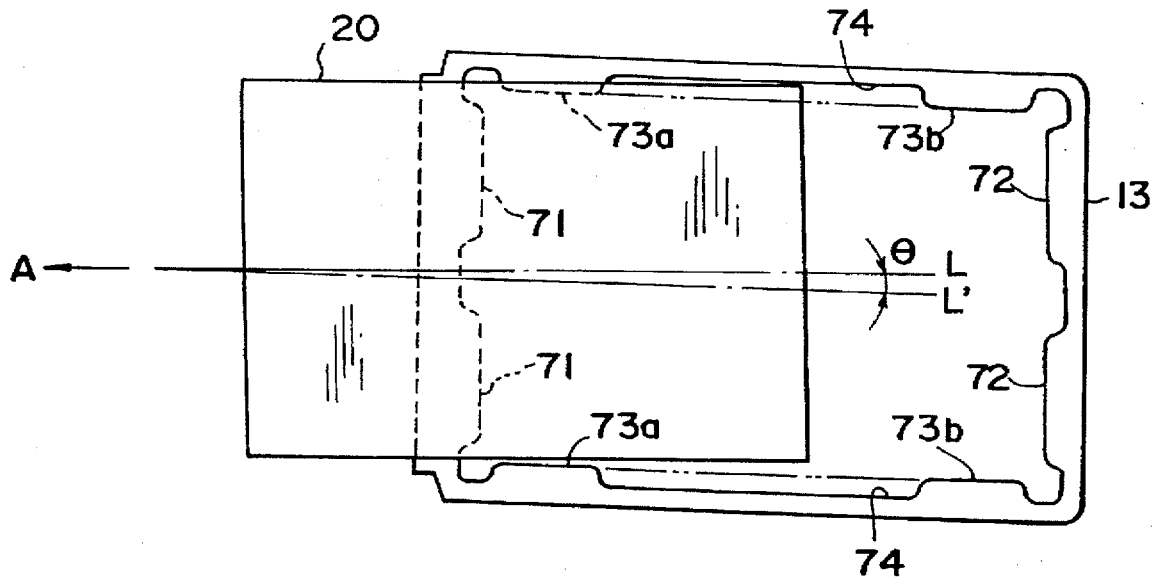
FIG. 7 is a top plan view illustrating the orientation correction process for film accommodated in the magazine.
Figure 8:
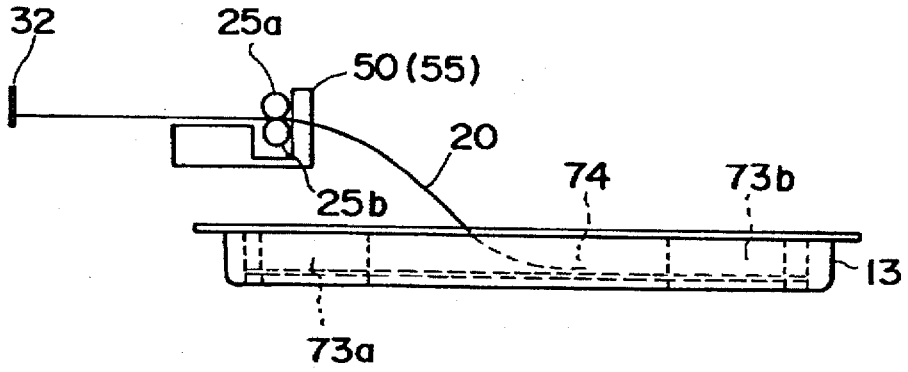
FIG. 8 is a front elevation view of the magazine shown in FIG. 7.

When the leading end of the film 20 contacts the stopper 32 and the skewing of the sheet 20 is corrected, or when the film 20 is positionally adjusted by the lateral regulating panels 50 and 55, the leading end half of the film 20 is pulled out of the magazine 13, while the trailing half of the film 20 remains in the magazine 13, as shown in FIGS. 7 and 8. When the magazine 13 is set in a position (line L') having a dislocation of only an angle θ relative to the reference center line L, the film 20 is necessarily corrected to the position indicated by the solid line. A front rib 71, rear rib 72 and side ribs 73*a* and 73*b* are formed on the interior lateral walls of the magazine 13 to position the film 20 and augment the strength of the side walls. The side ribs 73*a* and 73*b* are positioned at the leading end and the back end of the side walls along the transport direction A, and the intermediate portions therebetween are provided concave portions 74.

Accordingly, when the film 20 is skew-corrected or positionally adjusted toward the position indicated by the solid line in FIG. 7, the trailing end of the film 20 is positioned in the concave portion 74, and the positional correction of the film 20 is unhindered. Conventionally, the side walls of magazine 13 are pulled out to the position indicated by the dashed line in the drawing, whereupon the trailing end of the film 20 contacts the side wall and adequate positional adjustment is impossible.

Figure 9:
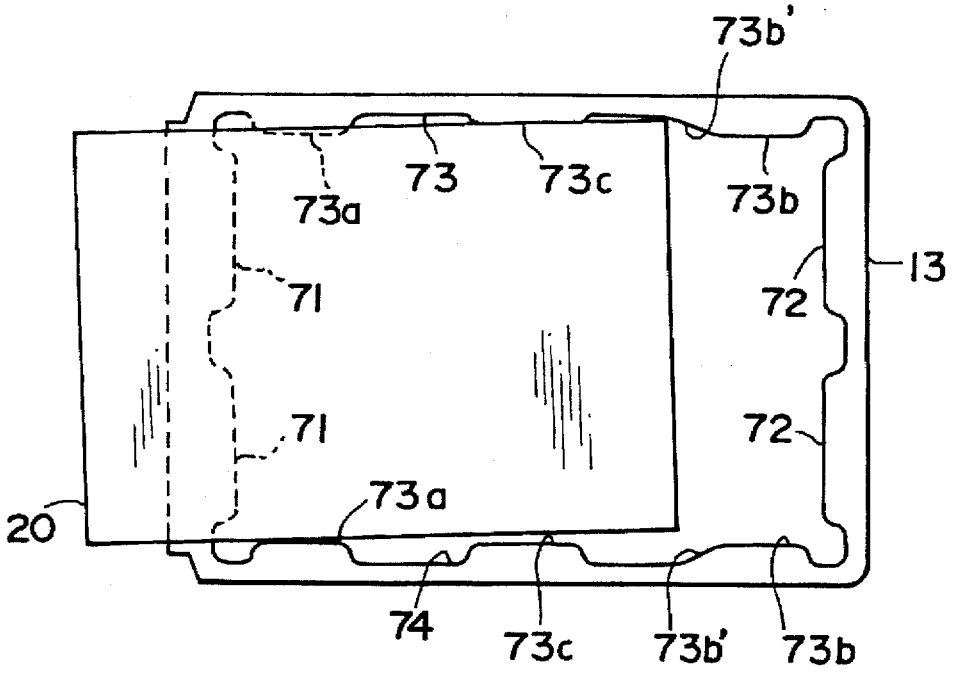
FIG. 9 is a top plan view of a modification of the magazine of the invention.
Figure 10:
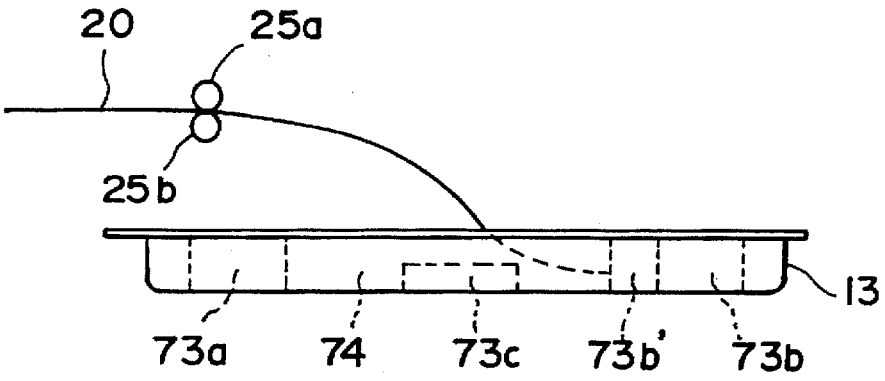
FIG. 10 is a front elevation view of the magazine shown in FIG. 9.

FIGS. 9 and 10 show another embodiment of the magazine.

The magazine 13 is provided a side rib 73*c* which is lower than the height of the side ribs 73*a* and 73*b* in the concave portion 74 disposed intermediately between the side ribs 73*a* and 73*b*, and the back side rib 73*b* is provided an inclined face 73*b*'. When the transportation of film 20 is improper, the film 20 is returned into the magazine 13 by the reversely rotated transport rollers 25*a* and 25*b*. The inclined face 73*b*' guides the trailing end of the film 20 during the film return, and the film 20 enters the magazine 13. Further, the side rib 73*c* provided in the concave portion 74 may be lower than the height of the side ribs 73*a* and 73*b* to augment the strength of the magazine 13, and the side rib 73*c* does not hinder the skewing correction or positional adjustment of the film 20.

The mechanism and method for setting the magazine 13 is described below.

Figure 11:
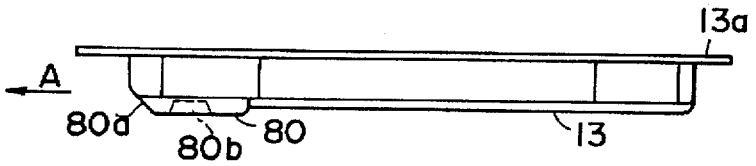
FIG. 11 is a front elevation view of the magazine showing the installing mechanism of the magazine of the invention.
Figure 12:
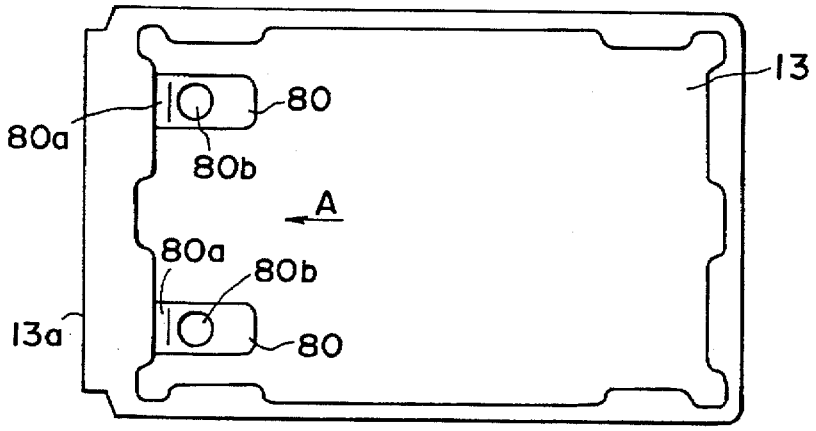
FIG. 12 is a bottom plan view of the magazine shown in FIG. 11.
Figure 15:
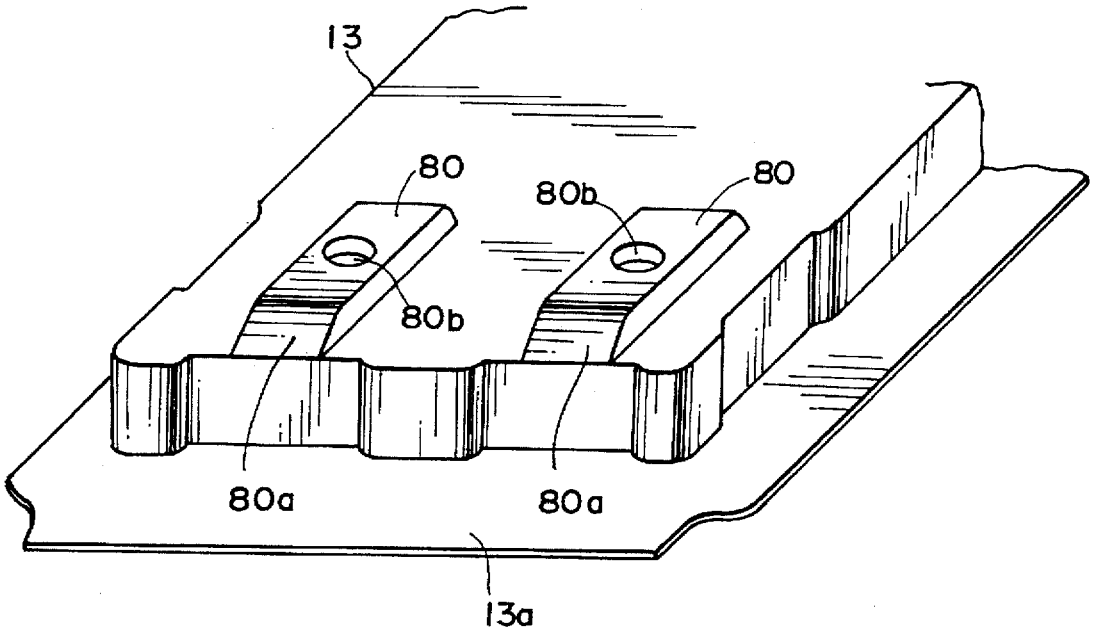
FIG. 15 is a perspective view showing the bottom surface of the magazine shown in FIGS. 11 and 12.

The magazine 13 is provided a pair of protruding portions 80 in the back surface of the leading end in the setting direction A, as shown in FIGS. 11, 12 and 15. The protruding portions 80 are provided inclined faces 80*a* rising in the setting direction A, and concave portions 80*b* positioned on the bottom surfaces of inclined faces 80*a*.

Figure 13:
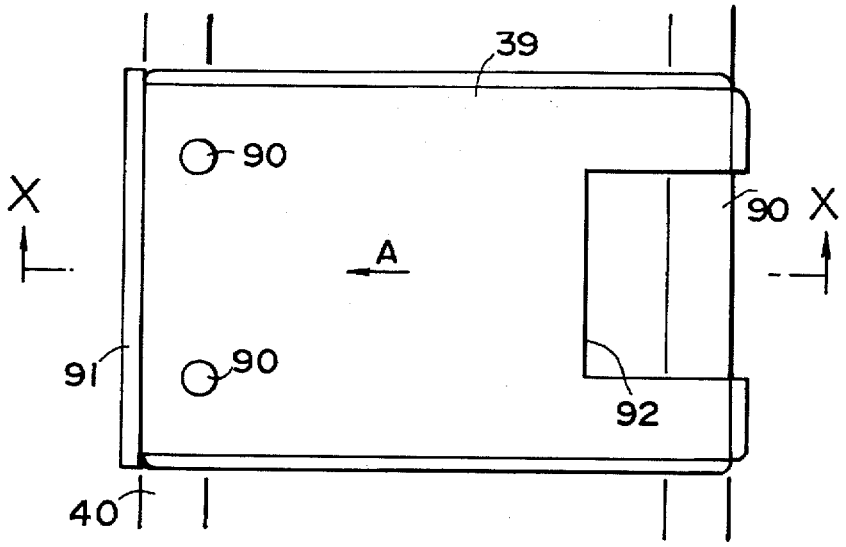
FIG. 13 is a top plan view of the loading platform.
Figure 14:
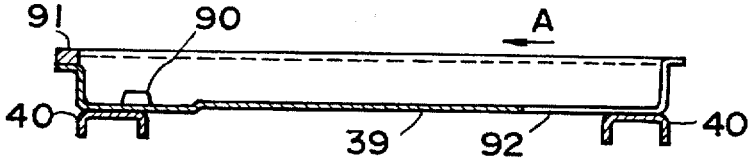
FIG. 14 is a sectional view along the X—X line of the loading platform shown in FIG. 13.

On the other hand, projections 90 are positioned to correspond to the concave portions 80*b* of magazine 13 on the leading end in the setting direction A, as shown in FIGS. 13 and 14. Viewed from the setting direction A, the leading end of the platform 39 is provided a cushion member 91, and the opposite end has a notch 92 formed therein to allow ready detachment of the magazine 13.

Figure 16A:
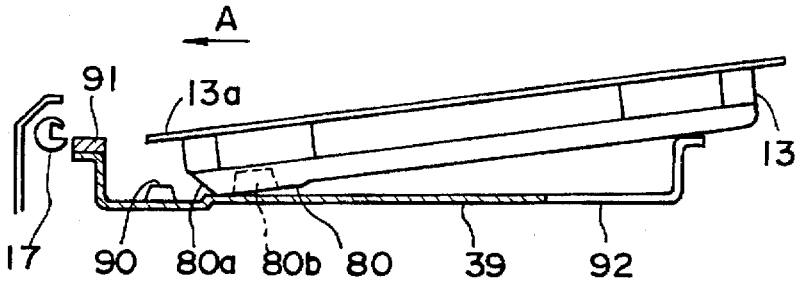
FIGS. 16*a* through 16*c* are illustrations showing the installation method of the magazine.
Figure 16B:
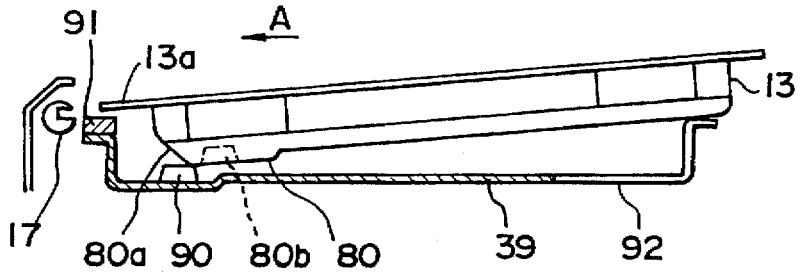

In setting the magazine 13 on the loading platform 39 with the platform 39 pulled out from the main body 11, first, the protruding portions 80 of magazine 13 make contact with the bottom plate of the platform 39, and, viewed from direction A, the back surface of the trailing end of the magazine 13 rides on the trailing end of the platform 39, as shown in FIG. 16*a*. When the magazine 13 is slid in the setting direction A, the inclined faces 80*a* of the protruding portions 80 on magazine 13 ride on the projections 90 of platform 39. Viewed from the setting direction A, the leading end of the flange 13*a* of magazine 13 is positioned above the cushion member 91 of platform 39 without penetrating said cushion member 91 (FIG. 16*b*).

Figure 16C:
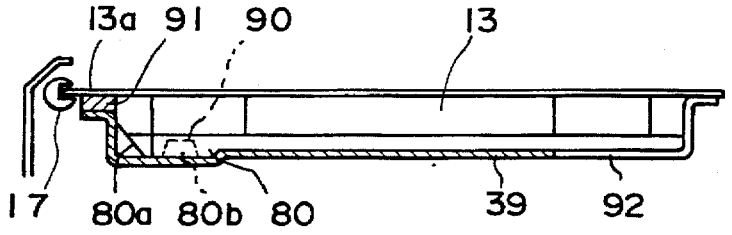

When the magazine 13 is pushed in the setting direction A, the concave portions 80*b* connect with the projections 90 of the platform 39, causing the magazine 13 to drop onto the platform 39 and complete the setting process (refer to FIG. 16*c*). At this time, the leading end of the flange 13*a* of magazine 13 is set on the cushion member 91 and the leading end part of the cover 41 connects with the winding shaft 17.

When the magazine 13 is extracted, the rear portion of the magazine is a held and lifted so as to pull the magazine in the direction opposite to that of direction A.

FIGS. 17 through 21*c* show another embodiment of the mechanism for setting the magazine 13.

Figure 17:
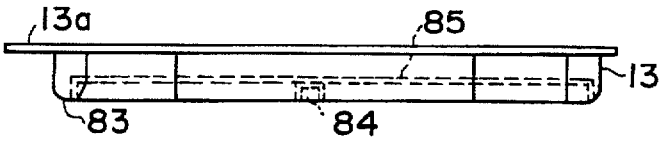
FIG. 17 is a top plan view of the magazine showing another embodiment of the installing mechanism of the magazine.
Figure 18:
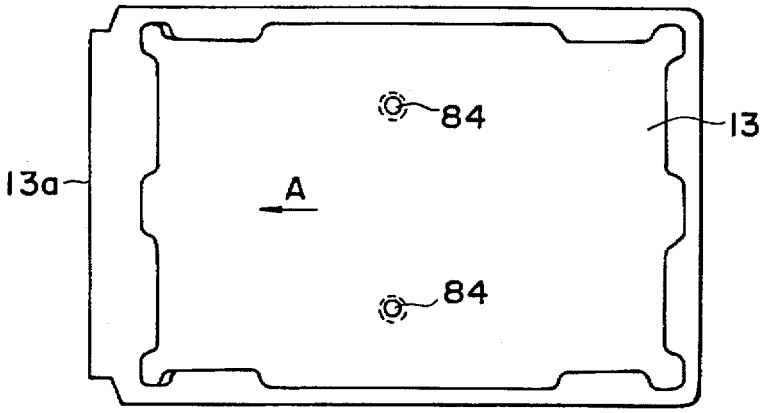
FIG. 18 is a bottom view of the magazine shown in FIG. 17.

In FIGS. 17 and 18, the magazine 13 is provided front corner portions 83 protruding laterally, and concave portions 84 on the back surface for positioning. A flat bottom plate 85 is provided within the magazine 13 to accommodate the film 20 in a flat state.

Figure 19:
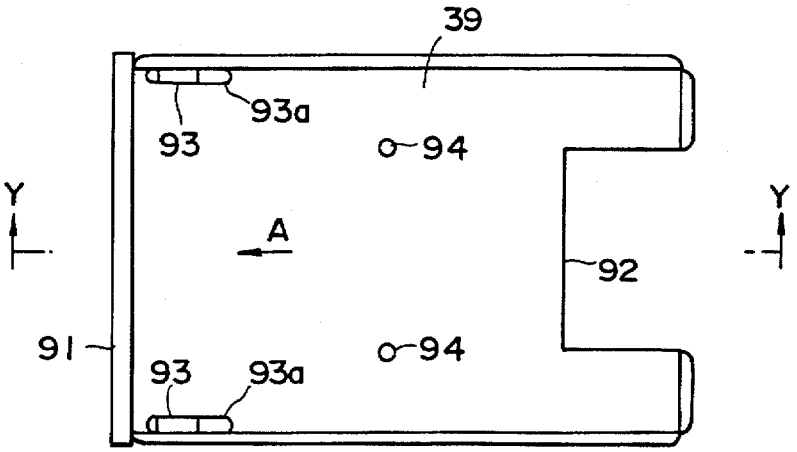
FIG. 19 is an elevation view of the loading platform corresponding to another embodiment of the installing mechanism of the magazine.
Figure 20:
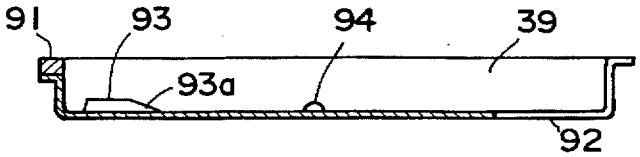
FIG. 20 is a sectional view along the Y—Y line of the loading platform shown in FIG. 19.
Figure 21A:
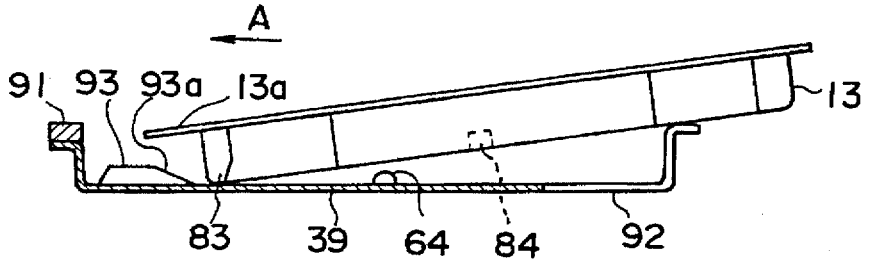
FIGS. 21*a* through 21*c* are illustrations showing the installation method for installing the magazine having the installing mechanism shown in FIG. 17 onto the loading platform shown in FIG. 20.
Figure 21B:
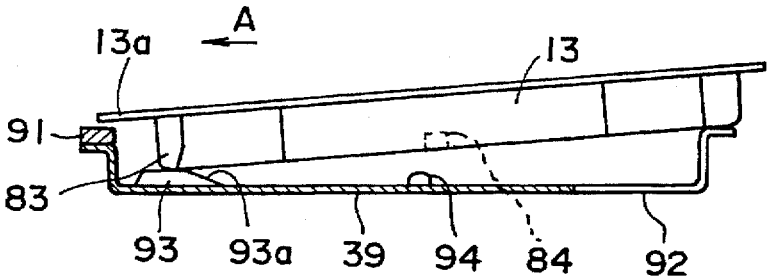
Figure 21C:
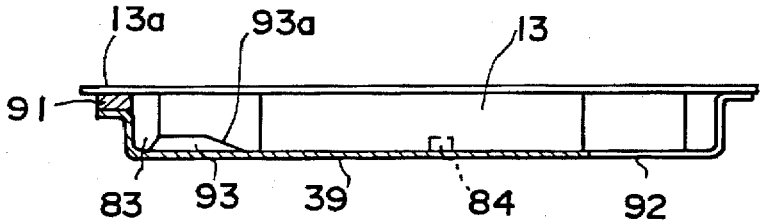

Viewed from the direction A, as shown in FIGS. 19 and 20, the interior leading end of the side walls of platform 39 are provided protruding portions 93 having inclined surfaces 93*a*. The bottom plate of platform 39 is provided positioning projections 94 corresponding to the concave portions 84 of magazine 13.

In setting the magazine 13 on the platform 39, viewed from the setting direction A, the leading end of the magazine 13 makes contact with the bottom plate of platform 39, and the back surface of the trailing end of the magazine 13 rides on the trailing end of the platform 39 (refer to FIG. 21*a*), in the same manner as described in the previous embodiment. Thereafter, when the magazine 13 is slid in the set direction A, the front corners 83 of the magazine 13 move from the inclined faces 93*a* of platform 39 and ride up on the protruding portions 93 (refer to FIG. 21*b*). Finally, when the magazine 13 is pushed in the setting direction A, the front corners 83 drop between the protruding portions 93 and the leading end of the platform 39, and the concave portions 84 of the magazine 13 connect with the projections 94 of the platform 39 to complete the setting in place of magazine 13 (refer to FIG. 21*c*). Viewed from the set direction A, the leading end of the flange 13*a* of magazine 13 rests on the cushion 91 of platform 39 without penetrating the cushion 91.

The operation for extracting the magazine 13 is identical to that of the previous embodiment. Viewed from the set direction A, the rear portion of the magazine 13 may be held and pulled in the opposite direction to that indicated by arrow A.

The mechanism for setting the magazine of the present invention is not limited to the mechanism described above, and may be modified variously inasmuch as such modifications do not depart from the scope of the aforesaid embodiment.

In particular, various modes may be used for connecting relationship of the magazine 13 and the platform 39, the relationship between the protruding portions 80 and concave portions 80*b* of magazine 13 and projections 90 of the platform 39, or the relationship between the corners 83 and concave portions 84 of the magazine 13 and the protruding portions 93 and projections 94 of the platform 39.

The operation of the printer 10 including the magazine and magazine platform of the present invention is described hereinafter with reference to the flow charts in FIGS. 22 and 23.

Figure 22:
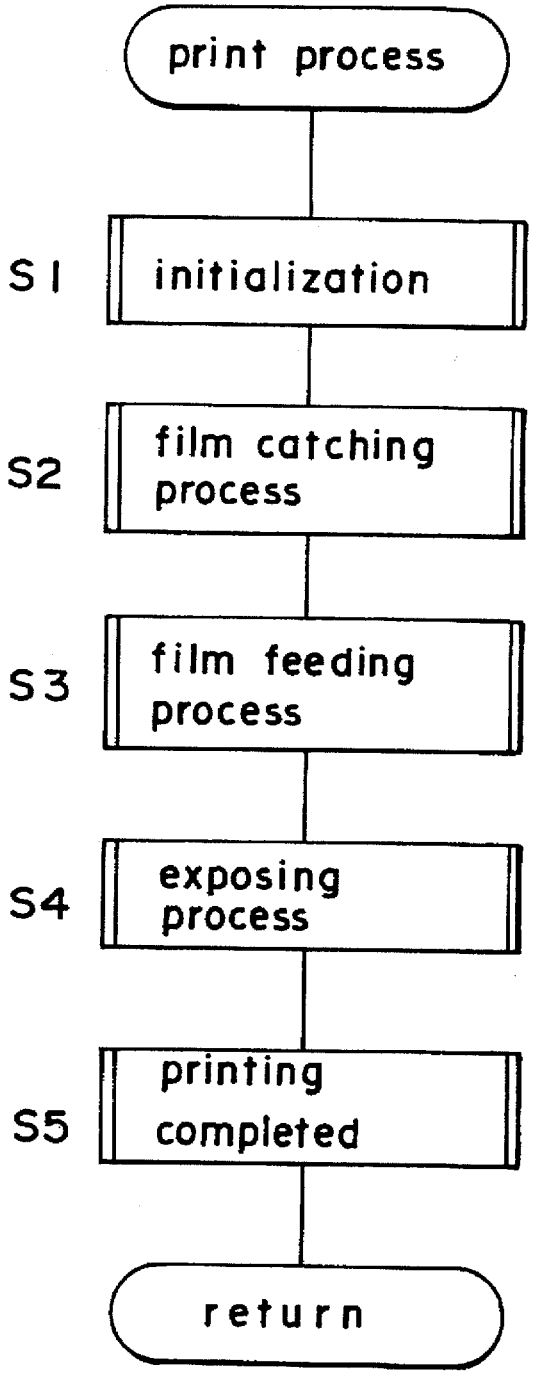
FIG. 22 is a flow chart showing the printing process of the printer.

FIG. 22 shows the printing process of the printer 10. The printing process is started by a print process signal transmitted from host device 1. It is to be noted here that the printing process is executable by switching on a print start switch provided on an operation panel (not shown in the drawings) of printer 10.

First, in step S1, the various parameters and settings for the optical unit 16 and the sub-scanning unit 18 are initialized. In step S2, a process is executed for feeding the uppermost sheet of film 20 from the magazine 13. That is, the vacuum disk 21 is lowered to suction and raise the film 20, and the leading end of the film 20 is gripped between the pair of transport rollers 25*a* and 25*b*. In step S3, the pair of transport rollers 25*a* and 25*b* are rotatably driven in the forward direction to transport the film 20 to the stopper 32 to accomplish skewing correction and widthwise positional correction of the film 20. The aforesaid transporting process is described more fully later with reference to the flow chart of FIG. 23.

In step S4, the film 20 is transported onto the sub-scan drum 36, and exposed to a modulated laser beam emitted from the optical unit 16, thereby forming an image on the film 20, whereupon the film 20 is accommodated in magazine 19. In step S5, the processing of a single sheet of film 20 is completed.

Figure 23:
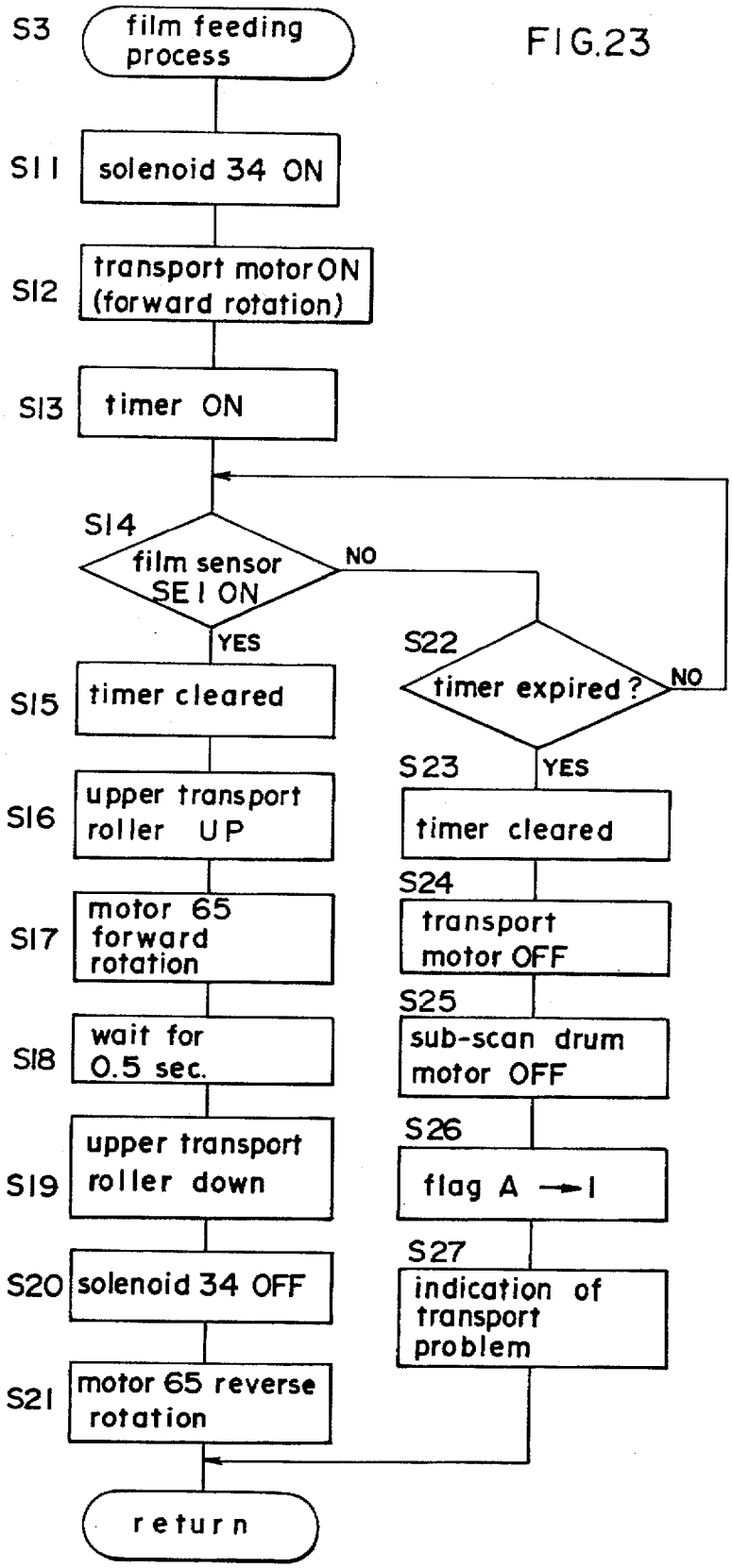
FIG. 23 is a flow chart showing the subroutines of the film transporting process of the printer.

FIG. 23 shows a subroutine of the film transporting process executed in step S3.

This subroutine starts from the state wherein the leading end of the film 20 is held between the pair of transport rollers 25*a* and 25*b*. At this time, the lateral regulating panels 50 and 55 are retracted about 5 mm to the outside of the film regulating position (retraction is accomplished in step S2).

First, in step S11, the solenoid 34 is switched on and the stopper 32 is interposed into the transport path. Then, in step S12, the transport motor is turned on to rotate the bottom transport roller 25*b* in the forward direction, thereby causing the film 20 to be transported in the arrow A direction onto the guide plate 29. At the same time, the timer is turned on in step S13, and a check is made in step S14 to determine whether or not the film sensor SE1 has switched on within the specified time period set by the timer, i.e., to determine whether or not the film 20 has been properly transported to the detection point of the film sensor SE1. If the film sensor SE1 has been switched on within the specified time period, the determination result is that the film 20 has been properly transported, then, the timer is cleared in step S15, and the top transport roller 25*a* is raised in step S16. Thus, the film 20 receives the transporting force imparted only by the bottom transport roller 25*b* in the arrow A direction while the leading end of the film 20 abuts the stopper 32, and any skewing of the film 20 is thereby corrected.

Then, in step S17, the pulse motor 65 is rotatably driven in the forward direction, and the lateral regulating panels 50 and 55 are moved inwardly from the retracted position. This movement continues until the slit 58*a* of the protruding member 58 is detected by the photosensor SE3, as shown in FIG. 3, such that the lateral regulating members 50 and 55 are moved to the regulating positions on both sides of the film, and the widthwise position of the film 20 is thereby adjusted. At this time, when viewed from the transport direction for the film 20, the trailing end of the film 20 is positioned in the concave portion 74 within the magazine 13, and the skewing correction and positional adjustment of the film 20 are adequately accomplished in the manner previously described.

In order to precisely execute the previously described processing, the apparatus is set at 0.5 second standby in step S18. Then, in step S19, the top transport roller 25*a* is lowered to re-grip the film 20, and in step S20, the stopper 32 is retracted from the transport path. At the same time, in step S21, the pulse motor 65 is reversely rotated and the lateral regulating panels 50 and 55 are retracted about 5 mm in an outward direction. Subsequently, the film 20 is subjected to the image exposure process described in step S4. At this time, the lateral regulating panels 50 and 55 are retracted somewhat outwardly to prevent disruption of the image formed on the film 20 induced by rubbing of the sides of the film 20 on the lateral panels 50 and 55 during the image exposure.

On the other hand, when the film sensor SE1 is not turned on within a specified time period in step S14, a time out is called in step S22 because the film 20 has not been properly transported, whereupon the transport motor is turned off in step S24 and the sub-scan drum drive motor is turned off in step S25 to effectively halt the film transport system. At the same time, because the film transport is inadequate prior to the exposure, the inadequate transport flag A is set to [1] in step S26 to indicate the condition of inadequate film transport prior to exposure on the operation panel of the printer 10, and the subroutine is completed.

When the inadequate film transport is detected, the pair of transport rollers 25*a* and 25*b* are reversely rotated via another subroutine not shown in the drawings, and a process is executed to return the film 20 to the magazine 13.

The magazine of the present invention is not limited to the embodiments previously described, and various modifications may be made inasmuch as such modifications do not depart from the scope of the invention. Furthermore, the sheet supplying device may employ various constructions and control means.

More specifically, various sizes of film 20 may be used with the magazine 13 of various sizes. Accordingly, the lateral regulating panels 50 and 55 and handling members 52 and 57 may be moved by the pulse motor 65 to regulating positions and retracted positions in accordance with the size of the film used. A means may also be provided for automatically detecting the film size when the magazine 13 is loading in the main body 11. Likewise, the operator may enter the film size on an operating panel not shown in the drawing.

Furthermore, a means other than the vacuum disk 21 described in the examples may be used as the film 20 pick up means.

Moreover, the sheets accommodated in the magazine 13 are not limited only to photosensitive film, but copy paper, and particularly coated paper may also be used.

Although the present invention has been fully described by way of examples with reference to the accompanying drawings, it is to be noted that various changes and modifications will be apparent to those skilled in the art. Therefore, unless such changes and modifications otherwise depart from the scope of the present invention, they should be construed as being included therein.

What is claimed is:

1. A sheet supply device for supplying sheets to an image forming apparatus one by one, said sheet supply device comprising:

storing means including a bottom plate having stacked sheets thereon, a front end, a back end and lateral side walls for storing the stacked sheets;

supply means for supplying the sheets from the storing means to the image forming apparatus one by one;

regulating means provided at said supply means to adjust and regulate the position of a sheet in a sheet width direction when the sheet is supplied to the image forming apparatus by the supply means; and reinforcing means provided at said lateral side walls to form a convex rib portion relative thereto so as to reinforce the side walls and initially align the position of the sheet in the sheet width direction in said storing means, said convex rib portion being out of engagement with the sheet when the sheet is supplied while being regulated by the regulating means.

2. A sheet supply device as claimed in claim 1 wherein the convex rib portion of said reinforcing means includes a first portion and a second portion, the first portion and the second portion having a concave portion formed therebetween.

3. A sheet supply device as claimed in claim 2 wherein the reinforcing means further includes a third portion provided at the concave portion, a height of the third portion being lower than that of the first and second portions.

4. A sheet supply device as claimed in claim 3 wherein the second portion has a tapered surface at a leading end thereof with respect to a sheet supply direction for guiding a rear end of the sheet when the sheet is returned into the storing means.

5. A sheet supply device as claimed in claim 1 wherein said regulating means has a pair of regulating members movable in a direction perpendicular to a sheet supply direction and one of which is provided with an elastic film.

6. A sheet supply device as claimed in claim 1 wherein said supply means includes adhering means for adhering an uppermost sheet of the stacked sheets in the storing means upon supply of the sheet.

7. A sheet supply device for supplying sheets to an image forming apparatus one by one, said sheet supply device comprising:

storing means including a bottom plate having stacked sheets thereon, a front end, a back end and lateral side wails for storing the stacked sheets;

supply means for supplying the sheets from the storing means to the image forming apparatus one by one;

regulating means provided at said supply means to adjust and regulate the position of a sheet in a sheet width direction when the sheet is supplied to the image forming apparatus by the supply means; and reinforcing means in said storing means for reinforcing the lateral side walls extending in a sheet supply direction at leading and trailing portions of said lateral side walls, said leading and trailing portions being out of engagement with the sheet when the sheet is supplied while being regulated by the regulating means.

8. A sheet supply device for supplying sheets to an image forming apparatus one by one, said sheet supply device comprising:

storing means including a bottom plate having stacked sheets thereon, a front end, a back end and lateral side walls for storing the stacked sheets;

supply means for supplying the sheets from the storing means to the image forming apparatus one by one;

regulating means provided at said supply means to adjust and regulate the position of a sheet in a sheet width direction when the sheet is supplied to the image forming apparatus by the supply means; and reinforcing means for reinforcing the lateral side walls extending in a sheet supply direction at both leading portions or both trailing portions of said lateral side walls, said leading portions and trailing portions being out of engagement with the sheet when the sheet is supplied while being regulated by the regulating means.

9. A method performed in a sheet supply device for supplying sheets to an image forming apparatus one by one, said method comprising the steps of:

providing storing means having a bottom plate, a front end, a back end and lateral side walls surrounding the bottom plate for storing stacked sheets therein;

reinforcing the lateral side walls extending in a sheet supply direction at both ends of said storing means by means of reinforcing members;

first regulating the position of the sheets in a sheet width direction in the storing means by means of the reinforcing members;

supplying the sheets from the storing means one by one; and second adjusting and regulating the position of a supplied sheet in the sheet width direction by regulating members provided at said sheet supply device without the supplied sheet coming into contact with the reinforcing members.

10. An image forming apparatus comprising:

storing means including a bottom plate having stacked sheets thereon, a front end, a back end and lateral side walls for storing the stacked sheets;

image forming means for forming an image onto a sheet, a distance from the storing means to the image forming means being shorter than a length of a sheet stored in the storing means;

supply means for supplying the sheets from the storing means to the image forming means one by one;

regulating means provided at said supply means to adjust and regulate the position of a sheet in a sheet width direction when the sheet is supplied to the image forming apparatus by the supply means; and reinforcing means provided at said lateral side walls to form convex portions relative thereto so as to reinforce the side walls and regulate the position of the sheet in the sheet width direction, and a concave portion formed between the convex portions so as not to contact the sheet when the sheet is supplied while being regulated by the regulating means.

* * * * *